US006733842B1

(12) United States Patent
Becker et al.

(10) Patent No.: US 6,733,842 B1
(45) Date of Patent: May 11, 2004

(54) PROCESS FOR THE HIGH-SPEED ROTARY APPLICATION OF LIQUID COATING AGENTS

(75) Inventors: Michael Becker, Remscheid (DE); Dirk Holfter, Hagen (DE); Karl-Friedrich Doessel, Wuppertal (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/427,420

(22) Filed: May 1, 2003

(51) Int. Cl.[7] ..... B05D 1/02
(52) U.S. Cl. ..... 427/421; 427/475
(58) Field of Search ..... 427/421, 475

(56) References Cited

FOREIGN PATENT DOCUMENTS

DE 10107951 A1 9/2002

*Primary Examiner*—Bernard Pianalto
(74) *Attorney, Agent, or Firm*—Steven C. Benjamin

(57) ABSTRACT

A process for the high-speed rotary application of a liquid coating agent onto a substrate, wherein the process comprises the steps:

(a) direct supply of at least two liquid components in a specified quantity ratio which determines the qualitative and quantitative composition of the coating agent to at least one high-speed rotary atomizer or preparation of a premix from at least two liquid components in a specified quantity ratio which determines the qualitative and quantitative composition of the coating agent and supply of the premix to at least one high-speed rotary atomizer, (b) high-speed rotary atomization of the components directly supplied in step (a) or of the premix supplied in step (a) to the at least one high-speed rotary atomizer and (c) application of the material atomized in step (b) onto a substrate, wherein at least one of the components used in step (a) differs from at least one further component used in step (a) with regard to density by 0.05 to 2 g/cm$^3$ and/or with regard to flow time (DIN EN ISO 2431, DIN 4 cup, 20° C.) by 15 to 150 seconds.

13 Claims, No Drawings

PROCESS FOR THE HIGH-SPEED ROTARY APPLICATION OF LIQUID COATING AGENTS

FIELD OF THE INVENTION

The present invention relates to a process for the high-speed rotary application of liquid coating agents, wherein the coating agents are formed from at least two liquid components during the course of high-speed rotary application.

BACKGROUND OF THE INVENTION

When producing liquid coating agents, various liquid components must often be mixed together which, depending upon the viscosity and/or density of the liquid components to be mixed, may cause difficulties. A further complicating factor may arise if there is also a significant difference in the proportions by volume to be mixed of such components. This problem will immediately become clear as shown in the following examples. For example, it may be very problematic to mix a large volume of a highly fluid, low-density component with a small volume of a relatively viscous, high-density component, or a large volume of a highly fluid, high-density component with a small volume of a relatively viscous, low-density component.

The process according to the invention described below provides a surprisingly efficient solution to the above-described problems. The process eliminates the mixing problem from the coating production stage and instead relocates the mixing operation to the coating application stage and there overcomes the above described problems. The quality of the coatings obtained with the process according to the invention is very high.

SUMMARY OF THE INVENTION

A first embodiment of the invention relates to a process for the high-speed rotary application of a liquid coating agent onto a substrate, wherein the process comprises the steps:

(a) directly supplying at least two, preferably only two, liquid components in a specified quantity ratio which determines the qualitative and quantitative composition of the coating agent to at least one high-speed rotary atomizer, (b) high-speed rotary atomizing the components directly supplied in step (a) to the at least one high-speed rotary atomizer and (c) applying the material atomized in step (b) onto a substrate, wherein at least one of the components used in step (a) differs from at least one further component used in step (a) with regard to density by 0.05 to 2 g/cm$^3$ and/or with regard to flow time (DIN EN ISO 2431, DIN 4 cup, 20° C.) by 15 to 150 seconds.

The second embodiment of the invention relates to a process for the high-speed rotary application of a liquid coating agent onto a substrate, wherein the process comprises the steps:

(a) preparing a premix from at least two, preferably only two, liquid components in a specified quantity ratio which determines the qualitative and quantitative composition of the coating agent, (b) supplying the premix from step (a) to at least one high-speed rotary atomizer, (c) high-speed rotary atomizing the premix supplied in step (b) to the at least one high-speed rotary atomizer and (d) applying the material atomized in step (c) onto a substrate, wherein at least one of the components used in step (a) differs from at least one further component used in step (a) with regard to density by 0.05 to 2 g/cm$^3$ and/or with regard to flow time (DIN EN ISO 2431, DIN 4 cup, 20° C.) by 15 to 150 seconds.

DETAILED DESCRIPTION OF THE EMBODIMENTS

In the first embodiment, the coating agent is formed and applied from at least two liquid components virtually in a single operation. The at least two liquid components are directly supplied to the at least one high-speed rotary atomizer, for example, via a T-piece which is arranged immediately upstream from the feed orifice of the high-speed rotary atomizer(s) or is a component of the high-speed rotary atomizer(s). During coating of a substrate, the at least two liquid components are supplied to the at least one high-speed rotary atomizer in a specified quantity ratio which determines the qualitative and quantitative composition of the liquid coating agent, for example, using suitable metering devices, such as, for example, gear pumps.

In the second embodiment of the process according to the invention, the at least two liquid components are not directly supplied to the at least one high-speed rotary atomizer. Instead, the process comprises the additional, preceding step of producing a premix from components, as are directly supplied to the at least one high-speed rotary atomizer in step (a) of the first embodiment. Before application, the coating agent is initially prepared by mixing at least two liquid components in a specified quantity ratio which determines the qualitative and quantitative composition of the coating agent to form a premix, after which it is supplied to the at least one high-speed rotary atomizer and only then is it atomized and applied. Relative to the degree of mixing in the premix, the degree of mixing is increased on atomization and/or application. Premixing may proceed either continuously or discontinuously, but continuous premixing is preferred for the purposes of industrial mass-production coating. Continuous premixing may here be achieved in conventional manner, for example, by means of a multicomponent mixing unit, in particular, a two-component mixing unit, for example, a conventional static mixer, such as, a Kenics mixer, as is conventionally used in automotive original coating. During coating of a substrate, the at least two liquid components are supplied to the multicomponent mixing unit in a specified quantity ratio which determines the qualitative and quantitative composition of the liquid coating agent, for example, using suitable metering devices, such as, for example, gear pumps.

The term "premix" used in connection with the second embodiment refers to the mixture of the at least two liquid components of the liquid coating agent with a greater or lesser degree of mixing or homogenization which varies as a function of the nature of the premixed components. The term "premix" is intended to relate to the mixture which is fed into the high-speed rotary atomizer(s) and does not mean the mixture after having entered the bell dish of the rotary atomizer(s).

In both embodiments of the process according to the invention, at least two, preferably no more than four, but preferably only two, liquid components are used in step (a)

in a specified quantity ratio which determines the qualitative and quantitative composition of the coating agent. With regard to the quantity ratio, it is generally the case that the proportion by volume of the component with the largest proportion by volume is at most one hundred times, preferably at most ten times, as large as the proportion by volume of the component with the smallest proportion by volume.

The coating agent, i.e. the atomized material obtained in step (b) of the first embodiment or in step (c) of the second embodiment, is applied onto the substrate by high-speed rotary application, preferably by electrostatically-assisted high-speed rotary application. In the case of electrostatic support, the coating agent may be charged directly by means of the high-speed rotary bell or by external charging. The coating agent may be applied in one or more spray passes to any substrate, such as, for example, automobile bodies or body parts. The high-speed rotary atomizer(s) may be passed by means of an automatically controlled machine or a coating robot over the substrate surfaces to be coated.

Examples of high-speed rotary atomizers include conventional rotary bells suitable for the application of liquid coatings and are made of metal, for example, aluminum, titanium or refined steel, wherein the circular spray edges of the atomizers have a diameter of, for example, 5 cm to 12 cm. Examples of such rotary bells include the ECO-M bell (manufactured by DÜRR GmbH, Bietigheim Bissingen, Germany) or the G1 atomizer (manufactured by ABB Flexible Automation, Friedberg, Germany). The spray edges of the rotary bells may be unserrated, but are preferably serrated, and more preferably straight-, cross- or diagonally-serrated.

The circumferential velocity of the spray edge lies in the range of 3,000 to 25,000 m/min, preferably 10,000 to 25,000 m/min.

For the preferred range of the circumferential velocity of the spray edge of 10,000 to 25,000 m/min, this means that, if the spray edge has, for example, a diameter of 6.5 cm, the rotational speed (measured as revolutions per minute) will be in the range from, for example, 50,000 to 120,000 $m^{-1}$, or if the spray edge has, for example, a diameter of 5 cm, the rotational speed will be in the range from, for example, 65,000 to 156,000 $min^{-1}$. In each case, the preferred range of 10,000 to 25,000 m/min for the circumferential velocity of the spray edge is 10% to 150% higher than is used in the art for the rotary atomizing application of liquid coating agents.

In the present invention the outflow rate of the coating agent lies in the conventional range of 50 to 1,000 ml/min of coating agent per high-speed rotary atomizer.

Furthermore, it may be advantageous to operate the shaping air normally used in high-speed rotary atomization with large amounts of air of, for example, 100 to 600 l/min per high-speed rotary atomizer.

Without wishing to be bound by theory, it is assumed that the liquid components supplied directly to the high-speed rotary atomizer(s) in step (a) of the first embodiment or the premix supplied in step (b) of the second embodiment undergo highly effective homogenization, for example, in the form of fine dispersion of components or constituents of components of the coating agent, on the bell dish and/or on the spray edge during the actual atomization process and/or during the path to the substrate surface to be coated and/or when contacting the substrate surface.

At least one of the two components used in step (a) of both embodiments differs from at least one further component used in step (a) with regard to density by 0.05 to 2 $g/cm^3$, preferably by 0.1 to 1.5 $g/cm^3$ and/or with regard to flow time (DIN EN ISO 2431, DIN 4 cup, 20° C.) by 15 to 150 seconds, the difference in flow time being a measure for the difference in viscosity. Absolute values for the density of the components used in step (a) of both embodiments are, for example, in the range from 0.8 to 3 $g/cm^3$. Pigment pastes containing a large proportion of high-density pigments, for example, a barium sulfate paste, are here examples of components with densities in the upper range of values. Binder dispersions or solutions are in the lower range of density values, for example, from 0.8 to 1.1 $g/cm^3$. Absolute values for the flow time of the components used in step (a) of both components are in the range from, for example, 3 to 180 seconds. While the flow times of binder dispersions or solutions are, for example, in the range from 5 to 15 seconds, pigment pastes, for example, exhibit flow times in the range from 60 to 100 seconds. A difference between the flow times of at least one component and at least one further component used in step (a) in the range close to the lower limit of 15 seconds relates to the case of components used in step (a) which have flow times in the lower range of values. In the event that only components having flow times in the upper range of values are used in step (a), the difference between their flow times may be close to the lower limit of 15 seconds, but will conventionally be larger, although they will, of course, not reach the range close to the upper limit of 150 seconds.

The liquid coating agents to be applied using the process according to the invention may comprise non-aqueous or aqueous coating agents. Accordingly, the at least two liquid components used in step (a) of both embodiments of the process according to the invention may be comprised of one of a variety of combinations of liquid and conveyable, in particular pumpable, components including: (1) at least to non-aqueous components and without aqueous components, (2) at least one aqueous component and at least one non-aqueous component, (3) at least two aqueous components and without non-aqueous components, or (4) at least two non-aqueous components, water and without aqueous components. During the preparation of an aqueous coating agent in cases (2) and (3), water may be added if desired, for example, in order to obtain a particular solids content or a particular viscosity. In cases (2) and (3), the added water should not be regarded as one of the components of the aqueous coating agent. In all three cases (2), (3) and (4), the added water should not be confused with an aqueous component.

In the case of both non-aqueous and aqueous coating agents, the at least two liquid components used in step (a) of both embodiments of the process according to the invention may each comprise per se ready-to-apply coating agents which differ from one another, for example, with regard to the pigmentation thereof. They may, for example, comprise various pigmented mixing paints, for example, mixing paints of a different color shade, from a paint mixing system which, depending upon the nature of the pigmentation thereof and the desired pigmentation of the liquid coating agent to be applied, are used in a quantity ratio which determines the qualitative and quantitative composition of the liquid coating agent. One or more, per se ready-to-apply, unpigmented clear coat paints may also be present as constituents of the paint mixing system and accordingly be used in combination with one or more pigmented mixing paints.

In the preferred case of only two liquid components, for example, two differently pigmented, liquid coating agents may be used in step (a) of both embodiments of the process according to the invention. For example, when preparing primer surfacer coating layers, which many automotive manufacturers apply in non-chromatic color shades, it is possible in this manner to provide primer surfacer coatings of a very wide range of shades of grey for specific car bodies from a white primer surfacer coating agent and a black primer surfacer coating agent. This is, for example, of particular interest when it is desired to adapt the color of the primer surfacer to the color shade of the base coat or top coat which is to be applied as the following coating layer.

Alternatively, it is equally possible for the at least two liquid components used in step (a) of both embodiments of the process according to the invention to comprise components, at least one of which is not a per se ready-to-apply coating agent. The liquid coating agent may, for example, be formed by combining pigmented and/or unpigmented semi-finished products or by combining a per se ready-to-apply coating agent in the form of a pigmented, for example, white pigmented coating base or unpigmented coating base (clear coat), with at least one pigment paste (tinting paste). The at least one pigment paste may here, for example, be member of a series of pastes comprising variously pigmented pigment pastes.

The combination of an aqueous coating base component containing a hydroxy-functional binder with a non-aqueous polyisocyanate crosslinking component is, however, explicitly excluded from the components used in step (a) of the second embodiment of the invention.

The liquid coating agents contain water and/or organic solvent. Examples of organic solvents that may be used in the coating agents include glycol ethers, such as, butyl glycol, butyl diglycol, dipropylene glycol dimethyl ether, dipropylene glycol monomethyl ether, and ethylene glycol dimethylether; glycol ether esters, such as, ethyl glycol acetate, butyl glycol acetate, butyl diglycol acetate, and methoxypropyl acetate; esters, such as, butyl acetate, isobutyl acetate, and amyl acetate; ketones, such as, methyl ethyl ketone, methyl isobutyl ketone, diisobutyl ketone, cyclohexanone, and isophorone; alcohols, such as, methanol, ethanol, propanol, and butanol; aromatic hydrocarbons, such as, xylene, Solvesso 100 (mixture of aromatic hydrocarbons with a boiling range from 155° C. to 185° C.), Solvesso 150 (mixture of aromatic hydrocarbons with a boiling range from 182° C. to 202° C.) and aliphatic hydrocarbons.

The liquid coating agents contain at least one binder and optionally at least one paste resin. Non-aqueous coating agents contain binders dissolved and/or dispersed in organic solvents. Aqueous coating agents contain binders dissolved in water and/or in aqueously dispersed (emulsified and/or suspended) form. The binders may be physically drying, oxidatively drying or chemically self- or externally crosslinking. In the case of externally crosslinking binders, the coating agent may also contain crosslinking agents for the binders. Corresponding binders or binder/crosslinking agent systems are known to the person skilled in the art and require no explanation.

The liquid coating agents may contain at least one conventional color- and/or special effect-imparting, organic or inorganic pigment and/or at least one extender. Examples are carbon black, titanium dioxide, iron oxide pigments, azo pigments, perylene pigments, phthalocyanine pigments, aluminium pigments, mica pigments, talcum, and kaolin.

In addition to organic solvent(s) and/or water, binder(s), crosslinking agent(s) and pigment(s) and/or extender(s) the liquid coating agents may optionally also contain reactive diluents and/or conventional coating additives, such as, for example, neutralizing agents, levelling agents, dyes, light stabilizers, antioxidants, rheology control agents, antsettling agents, antifoaming agents, adhesion promoting substances, and catalysts.

The application process according to the invention may be used in the field of industrial coating with liquid coatings, in particular, in the production of coatings in automotive body and automotive body part original coating, for example, in the production of primer surfacer, color- and/or special effect-imparting base coat, top coat or clear coat layers. The coating layers prepared by the process according to the invention are of elevated quality.

The following examples illustrate the invention.

EXAMPLES

Examples 1 to 4 (Application of Aqueous Primer Surfacers)

Example 1

A conventional commercial white aqueous primer surfacer (Herberts Aqua Fill, R 63256.2 from DuPont Performance Coatings GmbH & Co. KG, Wuppertal, density 1.33 g/cm$^3$) and a conventional commercial black aqueous primer surfacer (Herberts Aqua Fill, R 63473.5 from DuPont Performance Coatings GmbH & Co. KG, Wuppertal, density 1.26 g/cm$^3$) were each conveyed using a metering gear pump in a 1:1 ratio by volume into a T piece, from which the product streams combined in this manner were immediately supplied to the feed orifice of a high-speed rotary atomizer (atomizer: ECO-M-bell from D(ÜRR). Application was performed by means of high-speed rotary application to a dry film thickness of 35 $\mu$m onto a conventional, cathodically electrodeposition coated metal test panel. During application, the 6.5 cm diameter spray edge had a rotational speed of 45,000 min$^{-1}$, corresponding to a circumferential velocity of 9,185 m/min. After flashing off for 10 minutes at 20° C., the metal test panel coated with aqueous primer surfacer was baked for 20 minutes at an object temperature of 160° C.

Example 2

Example 1 was repeated with the sole difference that a rotational speed of 70,000 min$^{-1}$ corresponding to a circumferential velocity of the spray edge of 14,287 m/min, was used.

Both in Example 1 and in Example 2, a grey primer surfacer coat was obtained which in each case provided a uniform color appearance to the observer.

Example 3

3.1 A mixture of 4.69 pbw (parts by weight) of Bayhydrol® D 270 (polyester, Bayer Leverkusen)

7.72 pbw,of water 0.65 pbw of a 10 wt.% aqueous solution of dimethylethanolamine 0.59 pbw of Surfynol 104 (50% in N-methylpyrrolidone, wetting additive from Air Products)

0.59 pbw of Additol® XW 395 (levelling additive from Solutia)

11.54 pbw of titanium dioxide 1.15 pbw of black iron oxide 11.60 pbw of barium sulfate 0.40 pbw of Aerosil® R 972 (silica, from Degussa)

0.98 pbw of talcum was ground in conventional manner in a bead mill.

3.2 A mixture of 28.05 pbw of Bayhydrol® VP LS 2341 (polyurethane dispersion, Bayer Leverkusen)

24.38 pbw of Bayhydrol® XP 2438 (polyester urethane dispersion, Bayer Leverkusen)

7.55 pbw of Maprenal® VMF 3921 W (melamine resin from Solutia)

3.00 pbw of water 0.11 pbw of dimethylethanolamine was prepared.

The mixtures obtained in 3.1 and 3.2 (mixture 3.1: density 1.97 g/cm$^3$, flow time (DIN EN ISO 2431, DIN 4 cup, 20° C.) 70 seconds; mixture 3.2: density 1.06 g/cm$^3$, flow time (DIN EN ISO 2431, DIN 4 cup, 20° C.) 15 seconds) were each conveyed using a metering gear pump in a ratio by volume of mixtures 3.1:3.2 into a T piece, from which the product streams combined in this manner were immediately supplied to the feed orifice of a high-speed rotary atomizer (atomizer: ECO-M-bell from DÜRR). Application was performed by means of high-speed rotary application to a dry film thickness of 35 $\mu$m onto a conventional, cathodically electrodeposition coated metal test panel. During application, the 6.5 cm diameter spray edge had a rotational speed of 45,000 min$^{-1}$, corresponding to a circumferential velocity of 9185 m/min. After flashing off for 10 minutes at 20° C., the metal test panel coated with aqueous primer surfacer was baked for 20 minutes at an object temperature of 160° C.

Example 4

Example 3 was repeated with the sole difference that a rotational speed of 70,000 min$^{-1}$, corresponding to a circumferential velocity of the spray edge of 14,287 m/min, was used.

Both in Example 3 and in Example 4, a primer surfacer coat was obtained which in each case provided a uniform color appearance to the observer. However, the observed gloss appearance was greater in Example 4.

What is claimed is:

1. A process for the high-speed rotary application of a liquid coating agent onto a substrate, wherein the process comprises the steps:

(a) directly supplying at least two liquid components in a specified quantity ratio which determines the qualitative and quantitative composition of the coating agent to at least one high-speed rotary atomizer, (b) high-speed rotary atomizing the components directly supplied in step (a) to the at least one high-speed rotary atomizer and (c) applying the material atomized in step (b) onto a substrate, wherein at least one of the components used in step (a) differs from at least one further component used in step (a) with regard to density by 0.05 to 2 g/cm$^3$ and/or with regard to flow time (DIN EN ISO 2431, DIN 4 cup, 20° C.) by 15 to 150 seconds.

2. The process of claim 1, wherein the at least two liquid components used in step (a) comprise components, at least one of which is not a per se ready-to-apply coating agent.

3. The process of claim 1, wherein only two liquid components are used in step (a).

4. The process of claim 1, wherein the at least two liquid components used in step (a) each comprise per se ready-to-apply coating agents.

5. The process of claim 1, wherein the circumferential velocity of the spray edge of the at least one high-speed rotary atomizer is in the range from 3000 to 25000 m/min.

6. The process of claim 1, wherein the liquid coating agent comprises a coating agent selected from the group consisting of non-aqueous and aqueous coating agents.

7. A process for the high-speed rotary application of a liquid coating agent onto a substrate, wherein the process comprises the steps:

(a) preparing a premix from at least two liquid components in a specified quantity ratio which determines the qualitative and quantitative composition of the coating agent, (b) supplying the premix from step (a) to at least one high-speed rotary atomizer, (c) high-speed rotary atomizing the premix supplied in step (b) to the at least one high-speed rotary atomizer and (d) applying the material atomized in step (c) onto a substrate, wherein at least one of the components used in step (a) differs from at least one further component used in step (a) with regard to density by 0.05 to 2 g/cm$^3$ and/or with regard to flow time (DIN EN ISO 2431, DIN 4 cup, 20° C.) by 15 to 150 seconds.

8. The process of claim 7, wherein the liquid coating agent comprises a coating agent selected from the group consisting of non-aqueous and aqueous coating agents.

9. The process of claim 7, wherein only two liquid components are used in step (a).

10. The process of claim 7, wherein the at least two liquid components used in step (a) each comprise per se ready-to-apply coating agents.

11. The process of claim 7, wherein the circumferential velocity of the spray edge of the at least one high-speed rotary atomizer is in the range from 3000 to 25000 m/min.

12. The process of claim 7, wherein the at least two liquid components used in step (a) comprise components, at least one of which is not a per se ready-to-apply coating agent.

13. The process of claim 7, wherein premixing proceeds continuously or discontinuously.

* * * * *